United States Patent [19]

Juillard et al.

[11] 4,040,453

[45] Aug. 9, 1977

[54] SHUTTLELESS LOOM OF THE SINGLE OR DOUBLE LAYER TYPE

[75] Inventors: Yves Juillard; Victor Riner, both of Mulhouse, France

[73] Assignee: Societe Alsacienne de Constructions Mecaniques de Mulhouse, of Mulhouse Cedex, France

[21] Appl. No.: 710,703

[22] Filed: Aug. 2, 1976

[30] Foreign Application Priority Data

Aug. 4, 1975 France ..... 75.24220

[51] Int. Cl.[2] ..... D03D 47/18

[52] U.S. Cl. ..... 139/446; 139/449

[58] Field of Search ..... 139/440–446, 139/449, 20, 21

[56] References Cited

U.S. PATENT DOCUMENTS

| | | | |
|---|---|---|---|
| 1,957,024 | 5/1934 | Klemm | 139/449 |
| 2,688,344 | 9/1954 | Dewas | 139/449 |
| 3,159,186 | 12/1964 | Juillard | 139/446 |
| 3,916,956 | 11/1975 | Harris et al. | 139/21 |
| 3,948,297 | 4/1976 | Doriguzzi | 139/446 |

*Primary Examiner*—Henry S. Jaudon

[57] ABSTRACT

A loom is provided with a longitudinal sliding surface over the entire length of travel of the outer extremity of the needles and behind these latter; the coupling system which connects the driving member to the outer extremity of the needles comprises a shoe which slides over that face of the longitudinal surface which is directed towards the needles; an oscillating arm which drives the needles is urged elastically so as to apply the shoe against the longitudinal sliding surface.

5 Claims, 5 Drawing Figures

SHUTTLELESS LOOM OF THE SINGLE OR DOUBLE LAYER TYPE

FIELD AND BACKGROUND OF THE INVENTION

This invention relates to shuttleless looms with weft-inserting needles and more especially to looms of the so-called "flying needle" type in which the inner extremity or head of each needle rests freely on the bottom layer of warp threads in proximity to the reed whilst the outer extremity of said needle is freely pivoted to a driving member to which is imparted a reciprocating movement in the axial direction of the needle. In looms of this type, all the needle guides located inside the shed are dispensed with, the needles being accurately maintained under the action of gravity and inertia within the dihedral angle made by the bottom layer of warp threads with the plane of the reed. Looms of this type have been described in French patent No. 1,290,867.

The invention applies to looms of the aforesaid type, whether they have either a single or a double layer of warp threads but is of particular interest in the case of double-layer looms.

Up to the present time, the needle (or the two twin needles in the case of double-layer loom) was pivoted, for example by means of a universal joint, directly to the extremity of an oscillating lever which is mounted so that the extremity of this latter (which constitutes the actuating member aforesaid) carries out a rectilinear back-and-forth movement.

By reason of the fact that the oscillating lever aforesaid is of relatively substantial length (approximately 80 cm) and the fact that said lever is rotatably mounted and guided on members which are in turn capable of motion, said lever must be endowed with a high degree of rigidity in order to prevent vibrations of its upper extremity to which the needle is coupled.

It has become apparent, however, that when an attempt is made to increase the speed of the loom or when the lever is intended to actuate two needles (in the case of double-layer looms), this results in vibrations which have a harmful effect on the upper extremity of the lever and consequently on the needle or needles in spite of any steps which may be taken to increase the rigidity of the lever.

SUMMARY AND OBJECTS OF THE INVENTION

The aim of the present invention is to improve the straightness of travel of the outer extremity of the needles and to suppress the vibrations to which this extremity had been subjected.

The invention is directed to a loom of the aforesaid type which is provided over the entire length of travel of the outer extremity of the needles and behind said needles with a longitudinal sliding surface. The coupling system which connects the driving member to the outer extremity of the needles comprises a sliding shoe which slides over the face of said sliding surface which is directed towards the needles. Finally, elastic control means continuously apply the shoe against the sliding surface.

Preferably, the sliding surface aforesaid is constituted by a flat-face rail, the flat face of which is oriented in a direction parallel to the plane of the reed of the loom.

Preferably again, the shoe, aforesaid, is rigidly fixed to the extremity of the needle (or of the two needles in the case of a double-layer loom) whereas the driving member, and especially the extremity of the oscillating lever, aforesaid, is pivoted to the shoe.

The elastic control referred-to above can advantageously be produced by a stress applied to the oscillating lever or to a portion of said lever in order to apply the shoe against the slide-rail.

By virtue of these arrangements, vibrations of the needle extremities can be suppressed and it is possible in particular to increase the speed of the loom, even in the case of a double-layer loom in which two superposed needles are actuated by each lever.

A more complete understanding of the invention will be gained from the following detailed description and from the accompanying drawings in which a number of different embodiments of the invention are shown by way of example without any limitation being implied, and in which:

DESCRIPTION OF PREFERRED EMBODIMENTS

Figure 1:
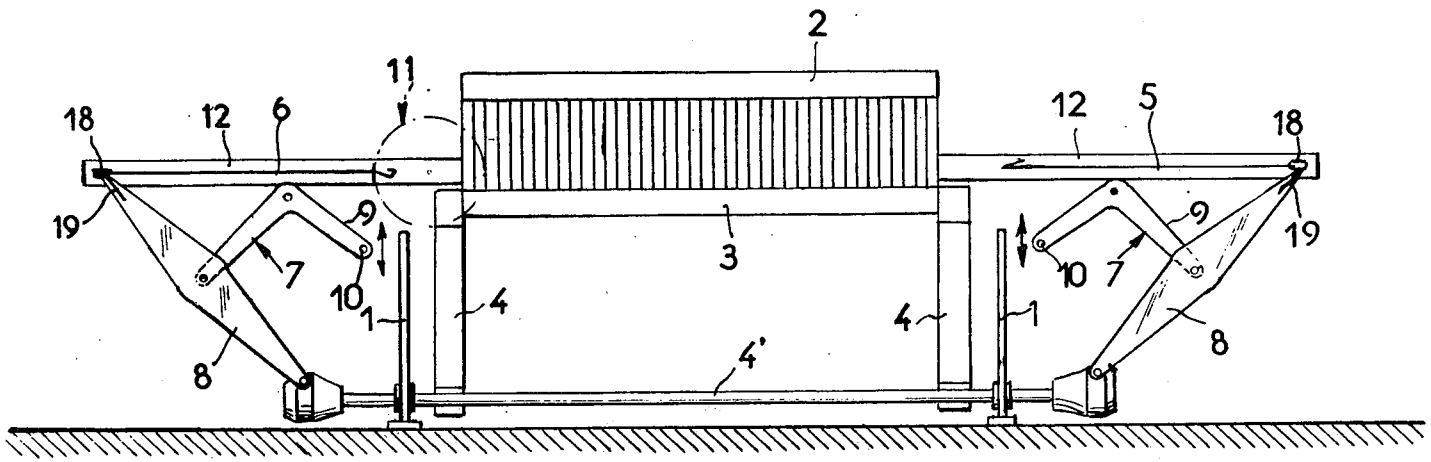
FIG. 1 is a diagrammatic view in elevation showing a loom in accordance with the invention.

The shuttleless single-layer loom which is illustrated diagrammatically in FIG. 1 comprises a frame 1, a reed 2 mounted on the slay 3, the swords 4 of which are pivotally mounted on a shaft 4'. The weft-inserting entry needle 5 and the weft-inserting exit needle 6 are each driven by an actuating mechanism 7 comprising an oscillating lever 8 which is actutated by an elbowed lever 9. The extremity 10 of the elbowed lever 9 is driven by any conventional system (not shown), for example, a cam-type mechanism. In accordance with known practice, the entire link-rod system of the mechanism 7 oscillates with the slay about the shaft 4'.

Figures 2, 3:
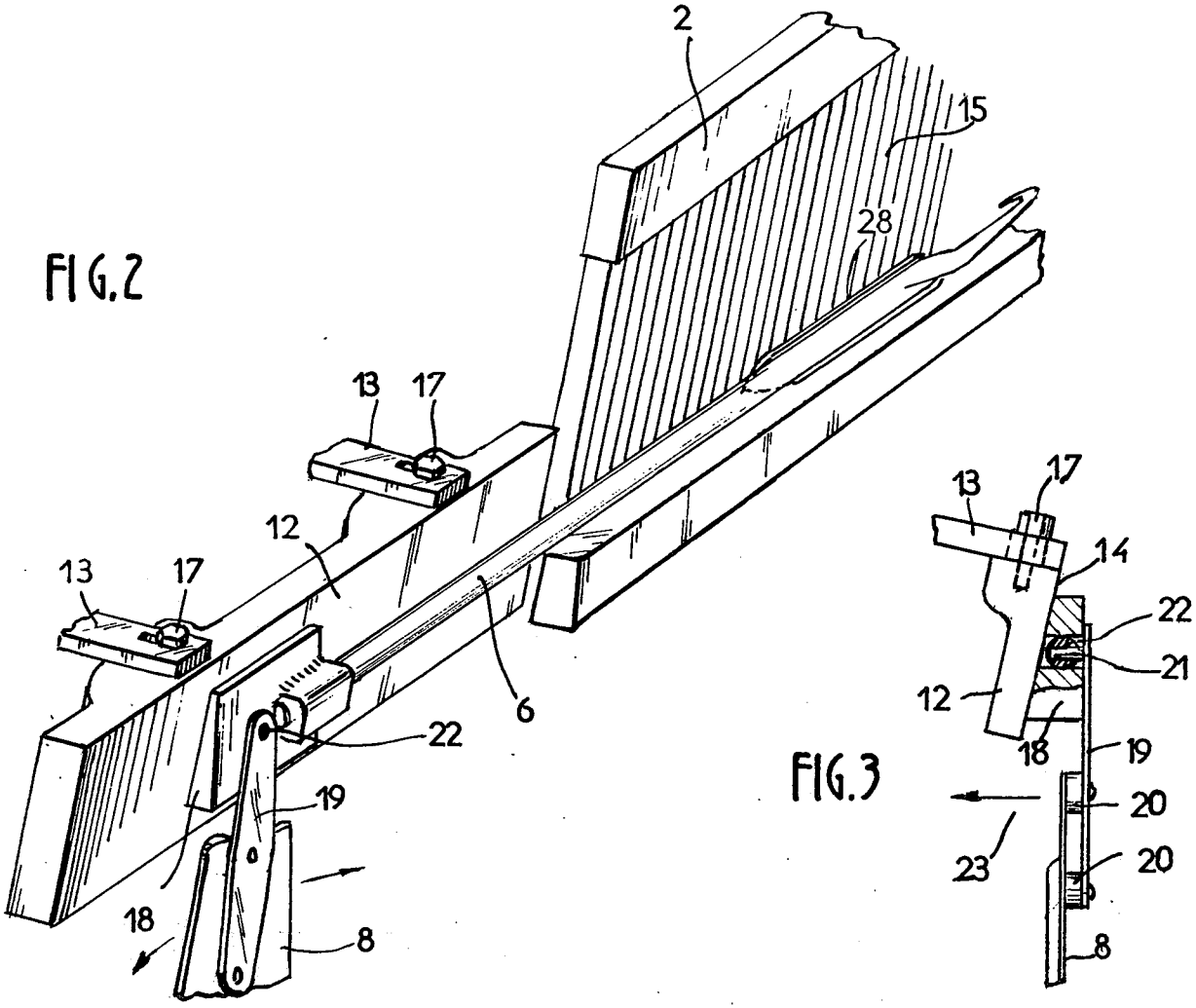
FIG. 2 is a partial view in perspective showing the actuating lever, the shoe and the sliding surface in the case of a loom of the single-layer type.
FIG. 3 is a sectional view showing the arrangement of FIG. 2.

There is shown in FIG. 2 that portion of the loom which is surrounded by a chain-dotted circle 11 in FIG. 1. The arrangement is identical on the opposite side of the reed.

In accordance with the invention, a longitudinal sliding surface constituted by a rail 12 having a flat face is secured by means of adjustable brackets 13 to a portion of the loom which is rigidly fixed to the slay. As shown in FIG. 3, the plane of the flat face 14 of the rail 12 is parallel to the plane of the reed 2 and it is preferably ensured that the flat face 14 is in the same plane as the front face of the teeth 15 of the reed 2, this adjustment in the same plane being carried out by means of the screws 17 of the brackets 13.

The needle is mounted in a sliding block or shoe 18 having a flat bearing face which is parallel to the plane of the reed and consequently to the flat face of the rail 12.

In accordance with known practice, the needle 6 is provided with skids 28 for guiding along the reed and the needle is mounted in the shoe 18 in such a manner as to ensure that the bearing faces of the needle skids and of the shoe are in the same plane.

The driving member of the needle 6 is formed by the extremity of the oscillating lever 8. This extremity can be consitituted by an arm 19 mounted on the lever 8 by means of spacers 20 so as to ensure that the plane of the web of the lever 8 passes through the center 21 of an articulation 22 of the ball-joint type, for example. By means of said articulation, the extremity of the arm 19 is coupled to the shoe 18 in the axis of the needle 6. It is clearly also possible to employ a counter-cranked lever 19 in order to maintain this coplanar arrangement which prevents any distortion in the web of the lever 8 at the moment of thrust exerted on the needle.

In accordance with the invention, the lever 8 is "set" or prestressed: in other words, its extremity is urged resiliently or elastically in the direction of the arrow 23 (as shown in FIG. 3) in such a manner as to ensure that the shoe 18 is continuously applied or urged against the rail 12. This accordingly eliminates guiding vibrations and makes it possible to increase the speed of the loom while permitting ready disassembly of the needle.

As can readily be understood, it is also possible to choose the reverse solution which consists in rigidly mounting the shoe at the extremity of the oscillating arm and in coupling the extremity of the needle to the shoe by means of an articulation.

In FIGS. 2 and 3, there is shown a conventional arrangement in which the plane of the reed 2 (and consequently the plane of the rail 12) is forwardly inclined with respect to the plane in which the lever 8 oscillates but it is readily apparent that the invention applies to the case in which the reed is straight. In this case, it is only necessary to choose a suitable value of the angle made by the bearing faces of the rail and of the shoe in order to ensure that these faces are always parallel to the plane of the reed.

The assembly which has just been described can readily be converted and adapted to double-layer looms, in which case the invention is even more advantageous since the weight of the two needles further increases the potential danger of vibrations of the extremity of the oscillating lever.

Figures 4, 5:
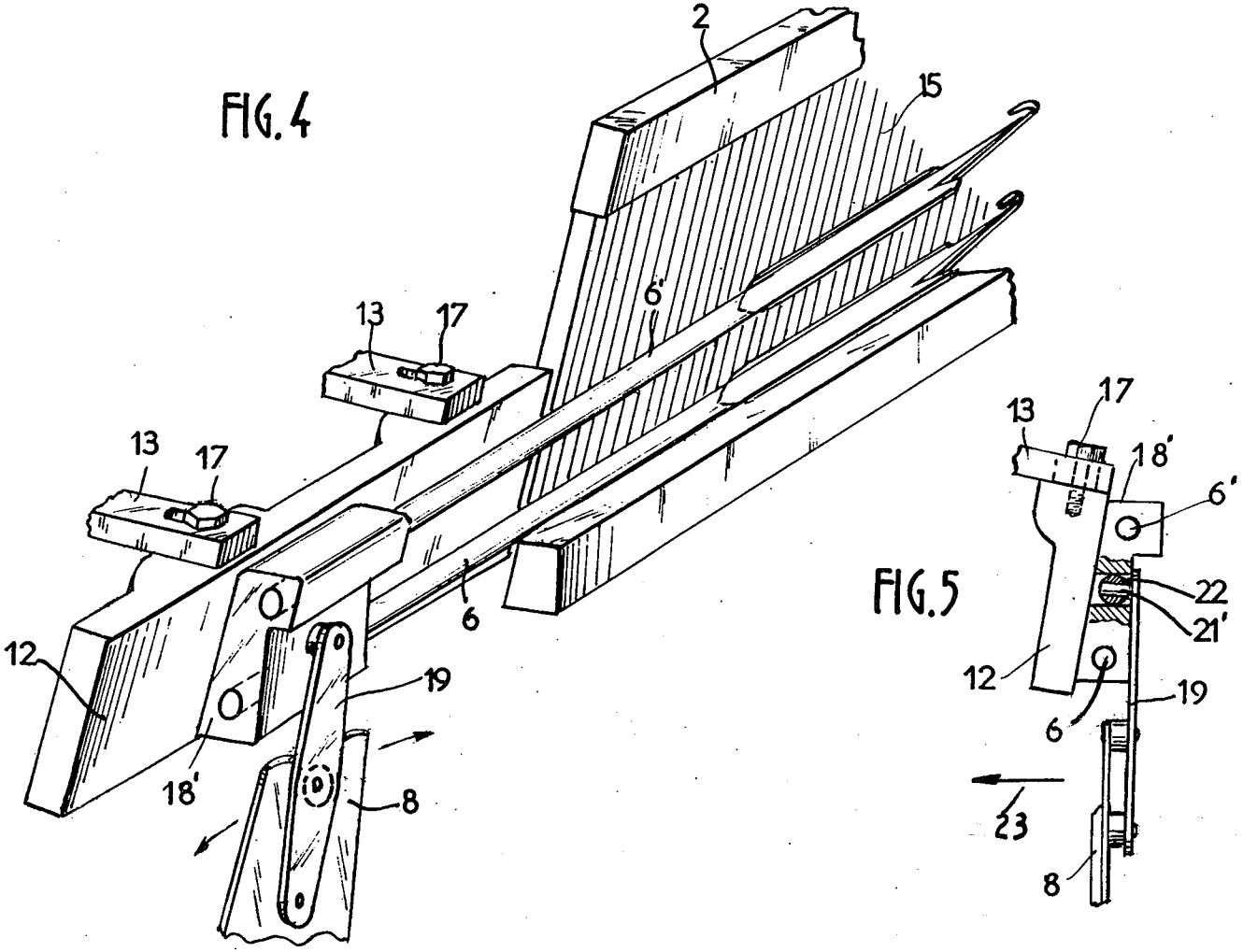
FIGS. 4 and 5 are views which are similar to FIGS. 2 and 3 but in the case of a loom of the double-layer type.

The arrangement adopted for a loom of the double-layer type is illustrated in FIGS. 4 and 5.

The guide-rail 12 and its positioning system 13–17 are identical with the arrangement described with reference to FIGS. 2 and 3. Thus the plane of the bearing face of the guide-rail is parallel and preferably coincides with the plane of the front face of the reed 2.

The needle 6 of the bottom shed and the needle 6' of the top shed are mounted in parallel relation within a block or shoe 18', the bearing face of the shoe, which is applied against the rail 12, being parallel to the plane of the reed.

The upper extremity of the arm 19 of the oscillating lever 8 is coupled to the shoe by means of an articulation 22 in which the center of thrust 21' is located halfway between the axes of the needles 6 and 6' and on the line which passes through these axes. As in the previous case, this center of thrust 21' is located in the plane of the web of the lever 8. Similarly, the extremity of the lever is urged elastically in the direction of the arrow 23 in order to ensure that the shoe is continuously applied against the guide-rail.

By virtue of the invention and in the case of double-layer looms, the needles are always in perfectly aligned and parallel relation and are guided without vibration solely by means of their outer extremities. The result thereby achieved is to ensure precise exchange of yarn between the entry needles and the exit needles and permits an appreciable increase in the speed of the loom.

As will readily be apparent, the invention is not limited to the embodiments hereinabove described and illustrated in the accompanying drawings but, depending on the applications which may be contemplated, can cover a broad range of alternative embodiments within the capacity of those versed in the art without thereby departing either from the scope or the spirit of the invention.

We claim:

1. A shuttleless loom, having a slay, a planar read carried by said slay, horizontal, longitudinally-reciprocating, floating weft-inserting needles, each having an inner extremity and an outer extremity with said inner extremity resting against said reed and a lower sheet of warp threads, and with said outer extremity being movable along a predetermined path of travel, a sliding shoe operatively connected to said outer extremity of each said needle, a driving member having a portion adapted to support said sliding shoe and to reciprocate in said path of travel of said outer extremity of said needle, an unbounded longitudinal sliding surface carried by said slay in coplanar, relationship with respect to said reed and extending close to said path of travel of said outer extremity of said needle.

and elastic means resiliently applying said sliding shoe against said sliding surface.

2. A loom according to claim 1 wherein said shoe is rigidly fixed to said outer extremity of said needle, said portion of said driving member being coupled to said shoe by articulation means.

3. A double-layer loom according to claim 1, wherein two superposed needles are coupled to said driving member by means of the shoe.

4. A loom according to claim 1, wherein the driving member is coupled to said shoe by means of an articulation whose center is located at the mid-point between the axes of the two needles which are mounted in said shoe.

5. A loom according to claim 1, wherein said driving member is constituted by the extremity of an oscillating lever, said elastic means being constituted by a resilient stress applied to at least a part of said lever.

* * * * *